United States Patent [19]

Seal et al.

[11] Patent Number: 4,780,727

[45] Date of Patent: Oct. 25, 1988

[54] COLLAPSIBLE BIFILAR HELICAL ANTENNA

[75] Inventors: William W. Seal, Covina; Joseph J. Badeau, Montclair, both of Calif.

[73] Assignee: Andrew Corporation, Orland Park, Ill.

[21] Appl. No.: 64,175

[22] Filed: Jun. 18, 1987

[51] Int. Cl.[4] ..... H01Q 1/36

[52] U.S. Cl. ..... 343/895; 343/880

[58] Field of Search ..... 343/895, 880, 883

[56] References Cited

U.S. PATENT DOCUMENTS

| | | | |
|---|---|---|---|
| 3,083,364 | 3/1963 | Scheldorf | 343/895 |
| 3,629,937 | 12/1971 | Fredriksson et al. | 343/895 |
| 3,699,585 | 10/1972 | Morrison | 343/895 |
| 3,737,912 | 6/1973 | Cribb | 343/895 |
| 4,475,111 | 10/1984 | Gittinger et al. | 343/895 |

FOREIGN PATENT DOCUMENTS

| | | | |
|---|---|---|---|
| 0209203 | 12/1983 | Japan | 343/895 |
| 1531925 | 11/1978 | United Kingdom | 343/895 |

OTHER PUBLICATIONS

Catalog 32, Andrew Systems, "Custom-Designed Antennas", p. 182, copyright 1983.

*Primary Examiner*—William L. Sikes
*Assistant Examiner*—Hoanganh Le
*Attorney, Agent, or Firm*—Stephen G. Rudisill

[57] ABSTRACT

A collapsible bifilar helical antenna comprises a rigid mast, a pair of flexible helical conductors wound about the mast, and a plurality of support arms spaced along the mast and extending radially outwardly therefrom for supporting the helical conductors, the support arms being movable along the axis of the mast to permit the helixes formed by the conductors to be expanded and contracted. The mast includes multiple sections which permit adjustment of the axial length of the mast. The support arms are mounted on sleeves which are slidable along the mast, each of the support arms has a tubular member mounted on the outer end thereof, and each of the flexible helical conductors comprises a metal cable which passes through the interiors of the tubular members.

4 Claims, 5 Drawing Sheets

COLLAPSIBLE BIFILAR HELICAL ANTENNA

FIELD OF THE INVENTION

The present invention relates generally to antennas and, more particularly, to bifilar helical antennas.

BACKGROUND OF THE INVENTION

One example of a bifilar helical antenna is described in Scheldorf U.S. Pat. No. 3,083,364, issued Mar. 26, 1963, and assigned to the assignee of the present invention.

SUMMARY OF THE INVENTION

It is a primary object of the present invention to provide a bifilar helical antenna which can be collapsed into a compact configuration to facilitate storage and transport of the antenna, particularly for field deployment by mobile communication units.

It is another important object of this invention to provide such an antenna which can be transported to a desired location in its collapsed condition and then quickly and easily deployed.

Still another object of the invention is to provide such an antenna which does not sacrifice any of the performance characteristics of bifilar helical antennas.

A further object of the invention is to provide such an antenna which can be efficiently and economically manufactured.

Other objects and advantages of the invention will become apparent from the following detailed description and upon reference to the accompanying drawings.

In accordance with the present invention, the foregoing objectives are realized by providing a collapsible bifilar helical antenna comprising a rigid mast, a pair of flexible helical conductors wound about the mast, and a plurality of support arms spaced along the mast and extending radially outwardly therefrom for supporting the helical conductors, the support arms being movable along the axis of the mast to permit the helixes formed by the conductors to be expanded and contracted. In the preferred embodiment, the mast includes multiple sections which permit adjustment of the axial length of the mast; the support arms are mounted on sleeves which are slidable along the mast; and each of the support arms has a tubular member mounted on the outer end thereof, and each of the flexible helical conductors comprises a metal cable which passes through the interiors of the tubular members.

DESCRIPTION OF THE PREFERRED EMBODIMENT

Figure 1:
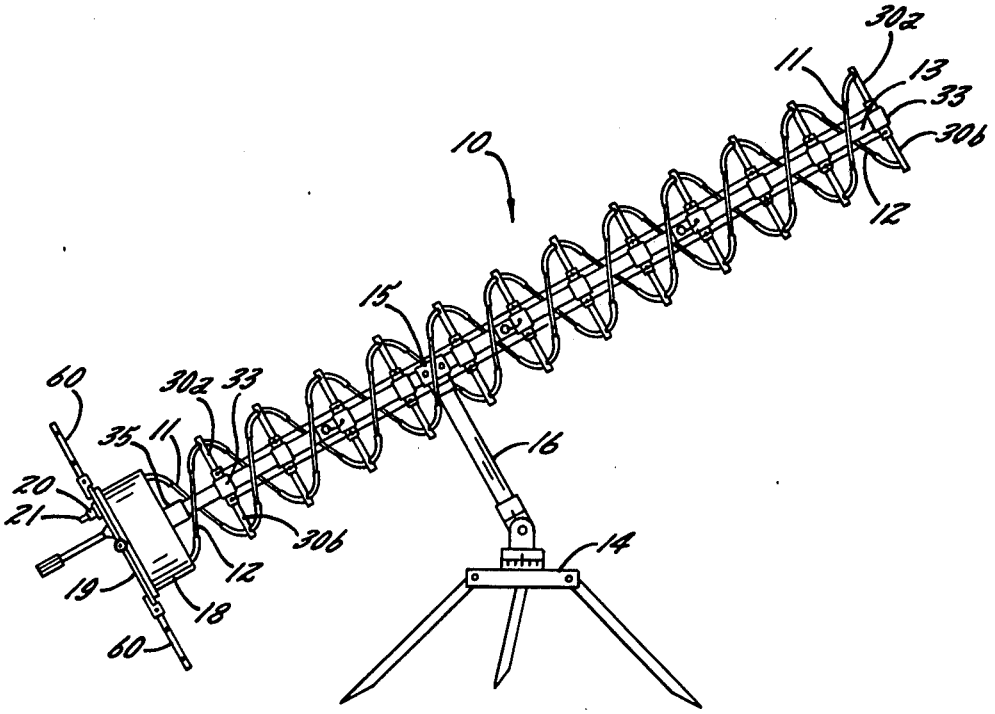
FIG. 1 is a perspective view of a bifilar helical antenna embodying the present invention.

While the invention is susceptible to various modifications and alternative forms, a specific embodiment thereof has been shown by way of example in the drawings and will be described in detail. It should be understood, however, that it is not intended to limit the invention to the particular form disclosed but, on the contrary, the intention is to cover all modifications, equivalents, and alternatives falling within the scope of the invention as defined by the appended claims.

Referring now to FIG. 1, a bifilar helical antenna 10 comprises two conductors 11 and 12 wound in helical configurations around a mast 13. The mast 13 of the antenna is mounted on a tripod 14 by means of a bracket 15 and an interconnecting arm 16. The helixes formed by the two conductors 11 and 12 preferably have the same pitch, diameter and length, but are 180° displaced from each other in the angular or circumferential direction. This is, of course, the conventional configuration for a bifilar helical antenna.

The lower ends of the helical conductors 11 and 12 are connected to a helical transformer section 17 (FIG. 2) comprising two fixed conductors **17*a* and 17*b* connected to the respective conductors 11 and 12. The transformer section 17 is surrounded by a cylindrical radome 18 attached to a ground-plane plate 19. The two conductors 17*a* and 17*b* are joined within the radome 18 (see FIG. 2), and the resulting single conductor 17*c* is connected to the center conductor of a Type N jack 20 for receiving a coaxial cable 21. It will be understood that the coaxial cable 21** can be used either to feed signals to the antenna from ground-based equipment, or to receive signals from the antenna and feed them to appropriate signal processing equipment.

In accordance with one important aspect of the invention, the two helical conductors are formed at least in part of flexible elements, and a plurality of support arms are spaced along the antenna mast and extend radially outwardly from the mast for supporting the helical conductors, the support arms being movable along the axis of the mast to permit the helixes formed by the conductors to be expanded and contracted. Thus, in the illustrative embodiment each of the conductors 11 and 12 is formed by a flexible bronze cable supported by a plurality of rigid insulating arms **30*a* and 30*b* extending radially outwardly from the mast 13 at equally spaced intervals along the length of the mast. Mounted on the end of each arm 30*a* is a pair of conductive hollow tubes 31*a* and 32*a* extending outwardly from opposite sides of the arm 30*a* to at least approximately conform to the desired helical configuration of one of the two conductors 11 and 12. A similar pair of conductive hollow tubes 31*b* and 32*b* are mounted on the end of the opposed support arm 30*b***.

Figure 2:
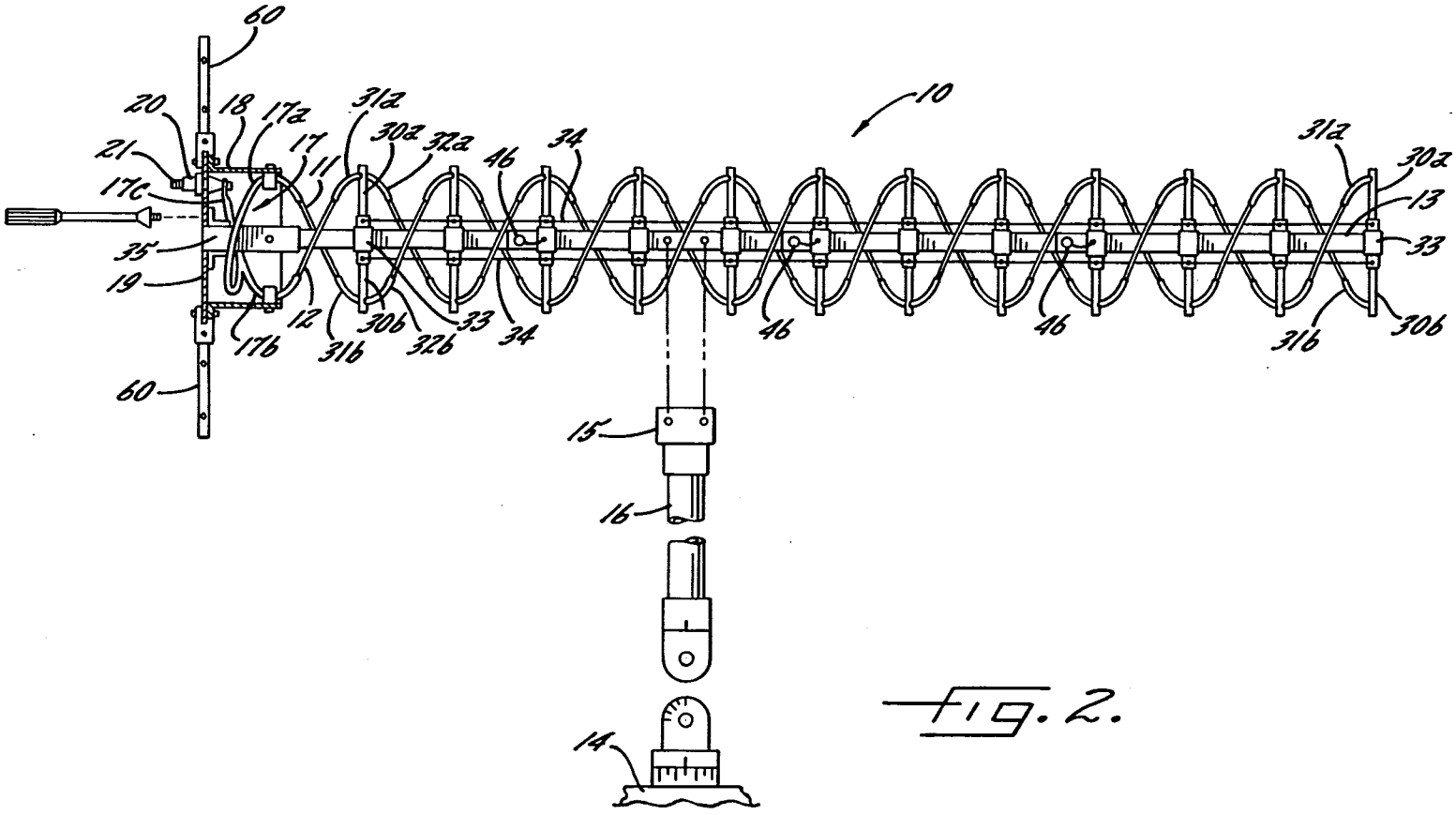
FIG. 2 is an enlarged side elevation of the antenna shown in FIG. 1, with the radome and ground-plane plate at the lower end of the antenna shown in section.

As can be seen most clearly in FIG. 2, the supporting structure for the conductors 11 and 12 is repeated at regular intervals along the length of the antenna mast, with the bronze cables 11 and 12 passing through the conductive tubes **31*a*, 32*a* or 31*b*, 32*b* on alternating sides of the mast 13 to form the desired helical configurations. As will be discussed in more detail below, the tubes mounted on the ends of the support arms 30***a* and 30*b* are free to slide over the bronze cables passing therethrough, thereby permitting the bifilar helical antenna to be collapsed and expanded by axial movement of the support arms 30*a* and 30i b along the mast 13.

To permit the support arms 30*a* and 30*b* to slide along the mast 13 in the longitudinal direction, each pair of opposed arms 30*a*, 30*b* are mounted on a sleeve 33 whose inner surface rides on the outer surface of the mast. As can be seen most clearly in FIG. 7, the support arms 30*a* and 30*b* are rigidly mounted on opposite sides of each sleeve 33.

Figure 6:
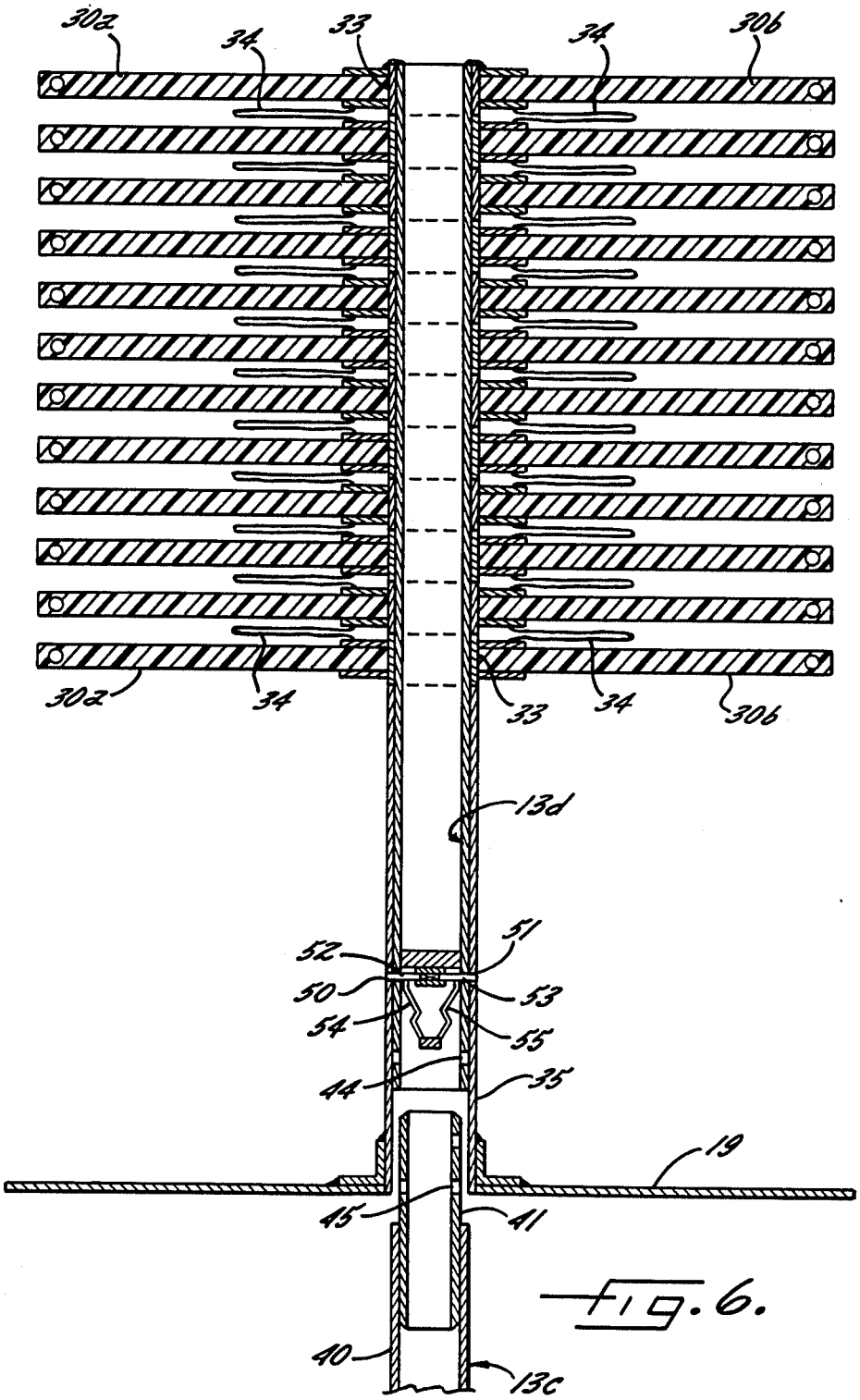
FIG. 6 is an enlarged vertical section through the structure shown in the upper central portion of FIG. 5, with the helical conductors removed.
Figure 7:
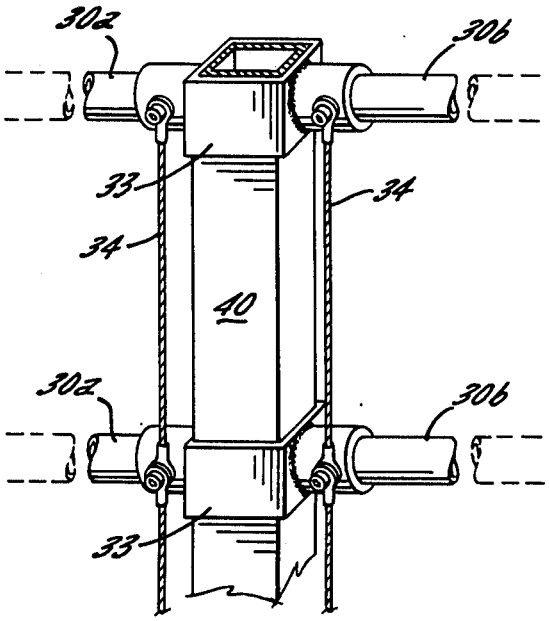
FIG. 7 is an enlarged perspective view of a fragment of the antenna as shown in FIGS. 1–4.

In order to limit the maximum spacing between adjacent sleeves 33, and to insure uniformity of the spacing between each pair of adjacent sleeves 33 when the antenna is in its fully expanded condition, a thin, flexible wire 34 connects each adjacent pair of support arms 30*a* or 30*b* (see FIGS. 6 and 7). These wires 34 are all of uniform length, thereby providing uniform spacing between each pair of adjacent support arms when the antenna is fully expanded. This uniform spacing in turn provides the helical conductors 11 and 12 with a uniform pitch along the entire length of the bifilar helix.

Figure 8:
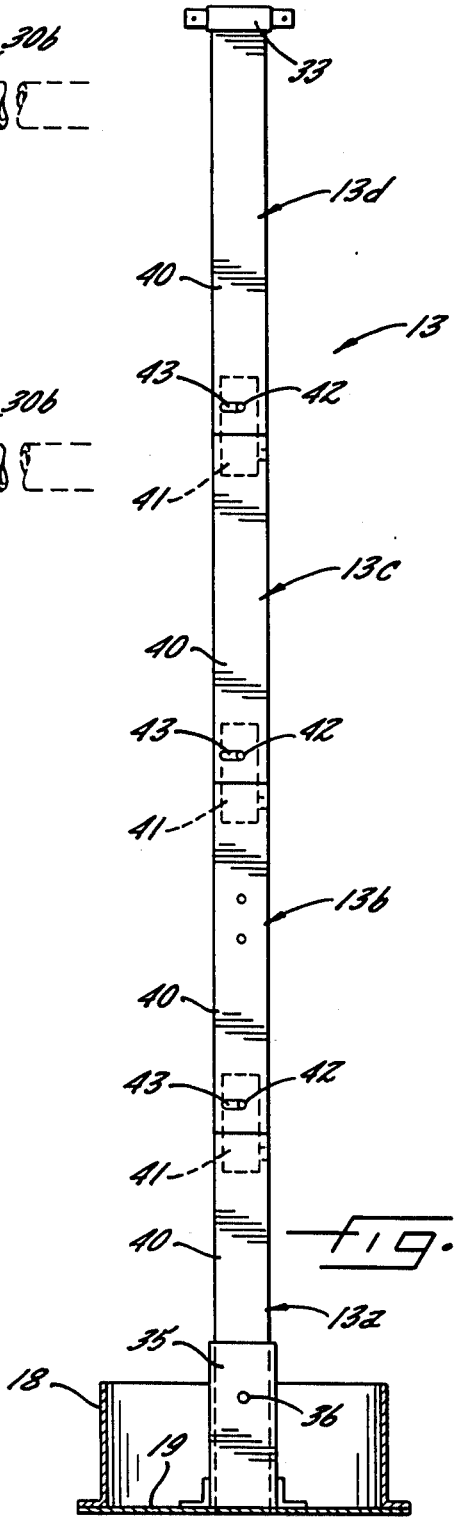
FIG. 8 is a side elevation of the mast of the antenna as shown in FIGS. 1–4, without the movable portions of the structure for supporting the helical conductors.

As can be seen most clearly in FIG. 8, the mast 13 is made in multiple sections 13*a*, 13*b*, 13*c* and 13*d* to permit adjustment of the axial length of the mast. FIG. 2 shows the mast in its assembled condition, with the helical conductors 11 and 12 fully expanded along the length of the mast. The lowermost section 13*a* of the mast has its lower portion telescoped within a complementary base member 35 welded to the ground-plane plate 19. A central aperture in the plate 19 provides access to the interior of the base member 35 so that the mast sections can be inserted into the base member from the underside of the plate 19, as will be described in more detail below. A pair of holes 36 are formed in opposed walls of the base member 35 (FIG. 8) so that a locking pin can be passed through the base member and a mast section therein to lock the mast to the base member. When it is desired to collapse the antenna, the locking pin is removed and the mast 13 is retracted downwardly through the base member 35.

As the mast is retracted through the base member 35, the sleeves 33 are drawn closer to each other, beginning at the upper end of the mast and progressing downwardly until the sleeves 33 and the support arms and conductors carried thereby have reached their fully collapsed condition FIGS. 2 and 6. The three lower mast sections 13*a*, 13*b* and 13*c* are disassembled for more compact storage as they are withdrawn from the base member 35, but the uppermost mast section 13*d* remains nested in the base member 35 so that it is not necessary to detach the bronze cables from the fixed transformer section 17. The nesting of the base member 35 and the fully collapsed helical portion of the antenna provides a compact subassembly which can be easily transported.

Figure 5:
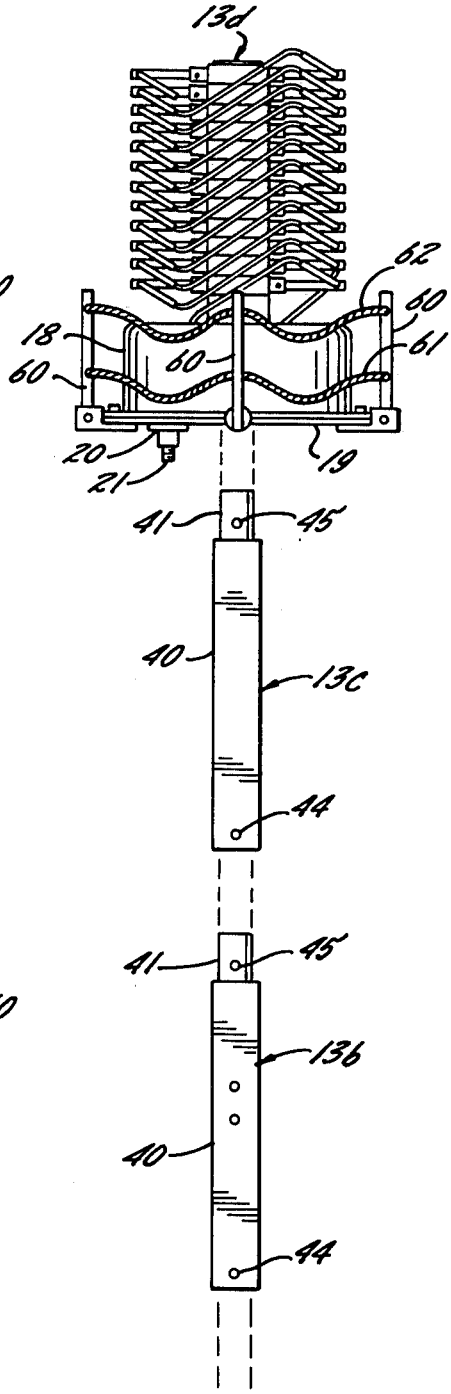
FIG. 5 is a side elevation of the antenna of FIGS. 1–4 in its collapsed and stowed position, and with certain segments of the mast of the antenna shown in exploded positions.
Figure 9:
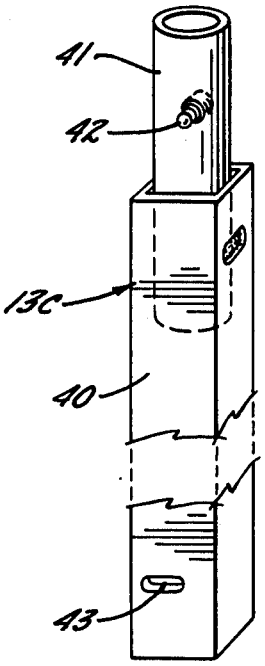
FIG. 9 is an enlarged perspective of one of the mast sections shown in FIG. 8.

As can be seen in the exploded view of FIG. 5 and the enlarged perspective in FIG. 9, each mast section comprises a length of square aluminum tubing 40 with a short section of smaller round aluminum tubing 41 inserted into one end of the square tubing and fastened thereto by welding. A portion of the round tubing 41 extends beyond the end of the square tubing to fit into the hollow interior of the adjacent end of the next mast section when the mast is assembled. The protruding portion of the round tubing 41 also carries a spring-loaded detent pin 42 which extends radially outwardly through a hole in the wall of the round tubing 41. When the round tubing 41 is inserted into the square tubing 40 of an adjacent mast section, the pin 42 is preferably aligned with a corner of the square tubing 40. The round tubing 41 is then rotated, causing the pin 42 to be retracted until it comes into register with a mating slot 43 in the square tubing, whereupon the pin 42 snaps into the slot 43 to lock the adjoining mast sections together. For additional security and stability, mating holes 44 and 45 may be formed in the mating portions of adjoining mast sections for receiving a locking pin 46, as illustrated in FIGS. 2, 5 and 6.

With the locking arrangement described above, the mast sections 13*a*–13*d* can be quickly assembled by simply inserting the small round tubing 41 of each section 13*a*–*c* into the open end of the square tube 40 of the preceding section, and then rotating at least one of the two adjoining sections until the locking pin 42 snaps into place. To disassemble the mast sections, each pin 42 is simply retracted by means of a suitable tool, so that the two mast sections can be pulled apart in the longitudinal direction. Of course, if the locking pins 46 are utilized, they must also be removed before the mast sections can be separated.

As shown most clearly in FIG. 6, the base member 35 is provided with a pair of diametrically opposed holes 50 and 51 for receiving a supplemental pair of spring-loaded detent pins 52 and 53 in the uppermost mast section 13*d*. When the mast section 13*d* is in its stowed position, as illustrated in FIG. 6, the pins 52 and 53 snap into complementary holes in the base member 35. It is this uppermost mast section 13*d* that is stowed on the base member 35 when the antenna is fully collapsed. Extending downwardly from the inner ends of the pins 52 and 53 inside the mast section 130 are a pair of spring fingers 54 and 55 which are connected at their lower ends. When it is desired to assemble the mast sections, the second mast section 13*c* is simply telescoped into the lower end of the base member 35 so that the small round tubing 41 extending from the upper end thereof fits over the spring fingers 54 and 55 to press them toward each other and thereby retract the detent pins 52 and 53. This releases the uppermost mast section 13*d* for movement out of the base.

The other two mast sections 13*a* and 13*b* are then similarly telescoped upward through the base member 35 (see FIG. 5) and connected to the respective preceding mast section in the manner described above. As the uppermost mast section 13*d* is moved upwardly by the insertion of the successive sections, the helical portion of the antenna is progressively expanded because the uppermost sleeve 33 is affixed to the upper end of the section 13*d*. As explained previously, the maximum spacing between adjacent sleeves 33 is limited by the interconnecting wires 34.

In accordance with a futher feature of the invention, the antenna also includes a collapsible ground plane. Thus, in the illustrative embodiment, six arms 60 are pivotally mounted at equal intervals around the circumference of the ground-plane plate 19. Each of these arms 60 is provided with a series of holes for receiving closed loops of flexible conductors 61 and 62. The radial spacing of these conductors 61 and 62 must be close enough to enable the entire assembly to function as an effective ground plane at the operating frequency of the antenna.

Figure 3:
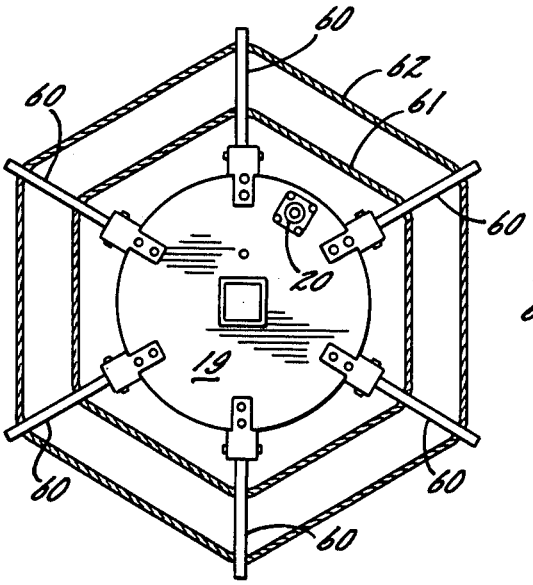
FIG. 3 is an end elevation taken from the left-hand end of the antenna as shown in FIG. 2.
Figure 4:
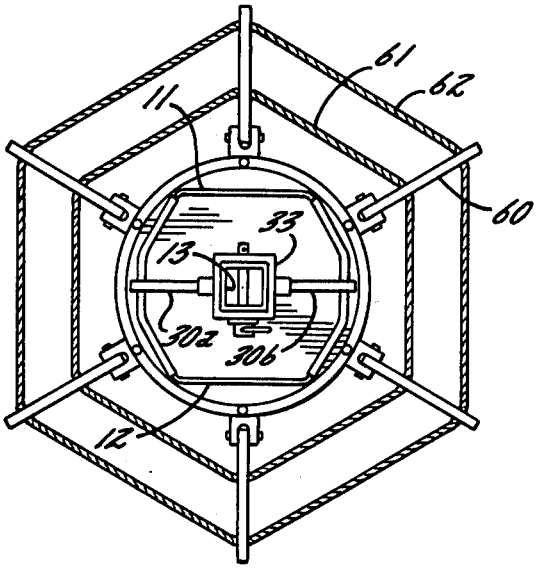
FIG. 4 is an end elevation taken from the right-hand end of the antenna as shown in FIG. 2.

When the antenna is in its collapsed condition, the arms 60 are pivoted upwardly along the walls of the radome 18, with the flexible conductors 61 and 62 hanging slack between adjacent arms, as illustrated in FIG. 5. When the antenna is deployed, the arms 60 are moved downwardly until they are parallel to the ground-plane plate 19, drawing the flexible conductors taut in the configuration shown in FIGS. 3 and 4.

As can be seen from the foregoing detailed description, the present invention provides a bifilar helical antenna which can be collapsed into a compact configuration to facilitate storage and transport of the antenna, thereby providing an antenna which is particularly useful for field deployment by mobile communication units. This antenna can be transported to a desired location in its collapsed condition and then quickly and easily deploy. Furthermore, the antenna does not sacrifice any of the performance characteristics of bifilar helical antennas, and the antenna can be efficiently and economically manufactured.

We claim:

1. A collapsible bifilar helical antenna comprising a rigid mast, a pair of flexible conductors wound about said mast in a helical configuration, and a plurality of rigid support arms spaced along said mast and extending radially outwardly therefrom for supporting said flexible conductors in said helical configuration, said support arms being movable along the axis of said mast to permit the helixes formed by said pair of flexible conductors wound about said mast to be expanded and contracted.

2. A collapsible bifilar helical antenna as set forth in claim 1, wherein said mast includes multiple rigid sections which permit adjustment of the axial length of said mast.

3. A collapsible bifilar helical antenna as set forth in claim 1 wherein said rigid support arms are mounted on sleeves which are slidable along the axial length of said mast.

4. A collapsible bifilar helical antenna as set forth in claim 1 wherein each of said rigid support arms has a tubular member mounted on the outer end thereof, and each of said flexible conductors comprises a flexible metal cable which passes through the interiors of said tubular members.

* * * * *